US005946965A

United States Patent [19]

Leone

[11] Patent Number: 5,946,965

[45] Date of Patent: Sep. 7, 1999

[54] VEHICLE WHEEL RIM STRAIGHTENER AND METHOD OF USE THEREOF

[76] Inventor: Frank Leone, 68-471 Commercial Rd., Cathedral City, Calif. 92234

[21] Appl. No.: 08/596,728

[22] Filed: Feb. 5, 1996

[51] Int. Cl.[6] ..... B21D 1/08

[52] U.S. Cl. ..... 72/392; 72/705

[58] Field of Search ..... 72/392, 705; 29/894.35, 29/894.353; 254/DIG. 10

[56] References Cited

U.S. PATENT DOCUMENTS

| | | | |
|---|---|---|---|
| 1,785,923 | 12/1930 | Wade | 72/392 |
| 1,837,690 | 12/1931 | Sunde | 72/392 |
| 2,395,469 | 2/1946 | Emrich | 72/392 |
| 2,718,253 | 9/1955 | Zinke | 72/392 |
| 2,764,215 | 9/1956 | Adams et al. | 72/392 |
| 3,577,881 | 5/1971 | Markovics | 72/392 |

*Primary Examiner*—Lowell A. Larson
*Attorney, Agent, or Firm*—Rothwell Figg Ernst & Kurz, P.C.

[57] ABSTRACT

A device for straightening out a vehicle wheel rim includes a ram and a hydraulic pump for manually operating the ram. Opposing pressure members are on located at opposite ends of the ram, and two semi-spherical contact members are contacted by the pressure members. In use, the semi-spherical contact members are fittable within a vehicle wheel rim for straightening a bent portion of the rim. The method is preferably performed with heating of the rim. Accordingly, the present invention provides a number of advantages which were not before possible with existing methods, including that the device can be completely portable, that the device does not require electricity nor other power source to operate, that it takes little training or expertise to operate, that it is relatively inexpensive to manufacture, and that it takes much less time than the currently used methods.

11 Claims, 4 Drawing Sheets

VEHICLE WHEEL RIM STRAIGHTENER AND METHOD OF USE THEREOF

BACKGROUND OF THE INVENTION

This invention relates generally to methods and apparatuses for straightening out vehicle wheels, and in particular to methods and apparatuses for straightening out the inner metal rim of a vehicle wheel.

As illustrated in FIG. 1, a normal vehicle wheel includes a tire T which is supported and retained on an assembly including a rim R and a center member 44 (FIG. 3) located inside of the rim R, commonly known as a disc or a spider, for attachment to an axle. Vehicle rims R can vary in basic dimensions and configurations; however, such rims generally include a generally horizontal portion R*h* (i.e. horizontal being generally parallel to the center axis of rotation of the vehicle wheel) below the tire beadwire T*b* and an upstanding flange portion R*f* which supports and retains the tire beadwire T*b*.

In the normal use of such vehicle wheels, the vehicle wheel rim is often bent and/or made crooked, especially the portions R*h* and R*f*—such as due to impact with rocks, roadside curbs, etc. and collisions. As a result and as illustrated in FIG. 2, the normal circular outer diameter D of the rim R receives discontinuities d. The discontinuities d being, as shown for example, inwardly projecting dents.

To this time, it has been a common practice to treat these discontinuities by pounding such discontinuities with a hammer, mallet, or the like. However, this common practice has a number of deficiencies—for example, (a) it can be inaccurate, (b) it is very time consuming, (c) it is very labor intensive, (d) it requires a significant expertise of the worker, and (e) it cannot usually be utilized to treat a substantial amount of discontinuities.

To this time, no other method and apparatus has been developed which avoids the above deficiencies and which is at the same time compact, light weight, portable, easy to use, and inexpensive to produce and operate.

SUMMARY OF THE INVENTION

An overall object of this invention is to provide an improved device for properly straightening out a vehicle wheel rim.

It is a further object of this invention to provide an improved device for straightening out a vehicle wheel rim which is compact, light weight, easy to use, and/or does not require a substantial number of parts and machinery.

It is a further object of the invention to provide an improved device for straightening out a vehicle wheel rim which does not have one or more of the noted problems.

The above and other objects are achieved in accordance with the present invention, in which:

According to a first aspect of the invention, a device for straightening out a vehicle wheel rim is providing which includes: a presser; opposing pressure members on opposite ends of the presser; a power device for powering the presser to move the opposing pressure members outwardly away from each other; a first semi-spherical contact member on a first of the pressure members; a second semi-spherical contact member on a second of the pressure members; the first and second semi-spherical contact members having outwardly facing spherical surfaces; wherein the first and second semi-spherical contact members are fittable within a vehicle wheel rim for straightening a bent portion of the rim.

According to a second aspect of the invention, the presser is a ram and the power device is a hydraulic pump.

According to a third aspect of the invention, the hydraulic pump is manually operated via a pump handle.

According to a third ask of the invention, the contact members are semi-spherical solid aluminum members.

According to a fourth aspect of the invention, a plurality of pairs of first and second contact members are removably replaceable on a first of the pressure members and a second of the pressure members, respectively, each the pair of first and second contact members having outwardly facing spherical surfaces differing in radius of curvature, whereby one a the pairs of first and second contact members can be fit within an appropriately sized diameter wheel rim for straightening a bent portion of the rim.

Although there has been a longstanding problem of such discontinuities in vehicle rims, the present invention had not been previously contemplated, and treatment of such discontinuities had not been as simply performed—especially, by lay persons or shop mechanics. The present invention has been especially designed to correct bends, indentations and other discontinuities in vehicle rims, while still being easily handled, etc., by such lay persons and shop mechanics.

Often discontinuities in the rim are, in essence, inward indentations caused by abutment with an object outside the diameter of the rim—e.g. as illustrated in FIG. 2. The present invention, which presses the inner surface of the rim, is also especially suited to correct such inward indentations, while being easily accommodated within the rim R. Therefore, the device provides an efficient structure specially suited and designed for use with discontinuities in vehicle wheel rims.

Accordingly, the present invention has significant advantages, including for example: (a) it can be completely portable, (b) it does not require electricity nor other power source to operate, (c) it takes little training or expertise to operate, (d) it is relatively inexpensive to manufacture, and (e) it takes much less time than the currently used methods.

The above and other (a) objects, (b) advantages, (c) features and (d) aspects of the present invention will be more readily perceived from the following description of the preferred embodiments thereof taken together with the accompanying drawings and claims.

BRIEF DESCRIPTION OF THE DRAWINGS

The present invention is illustrated by way of example and not limitation in the accompanying drawings, in which like references indicate like parts, and in which.

DETAILED DESCRIPTION OF THE PREFERRED EMBODIMENTS

Figure 1:
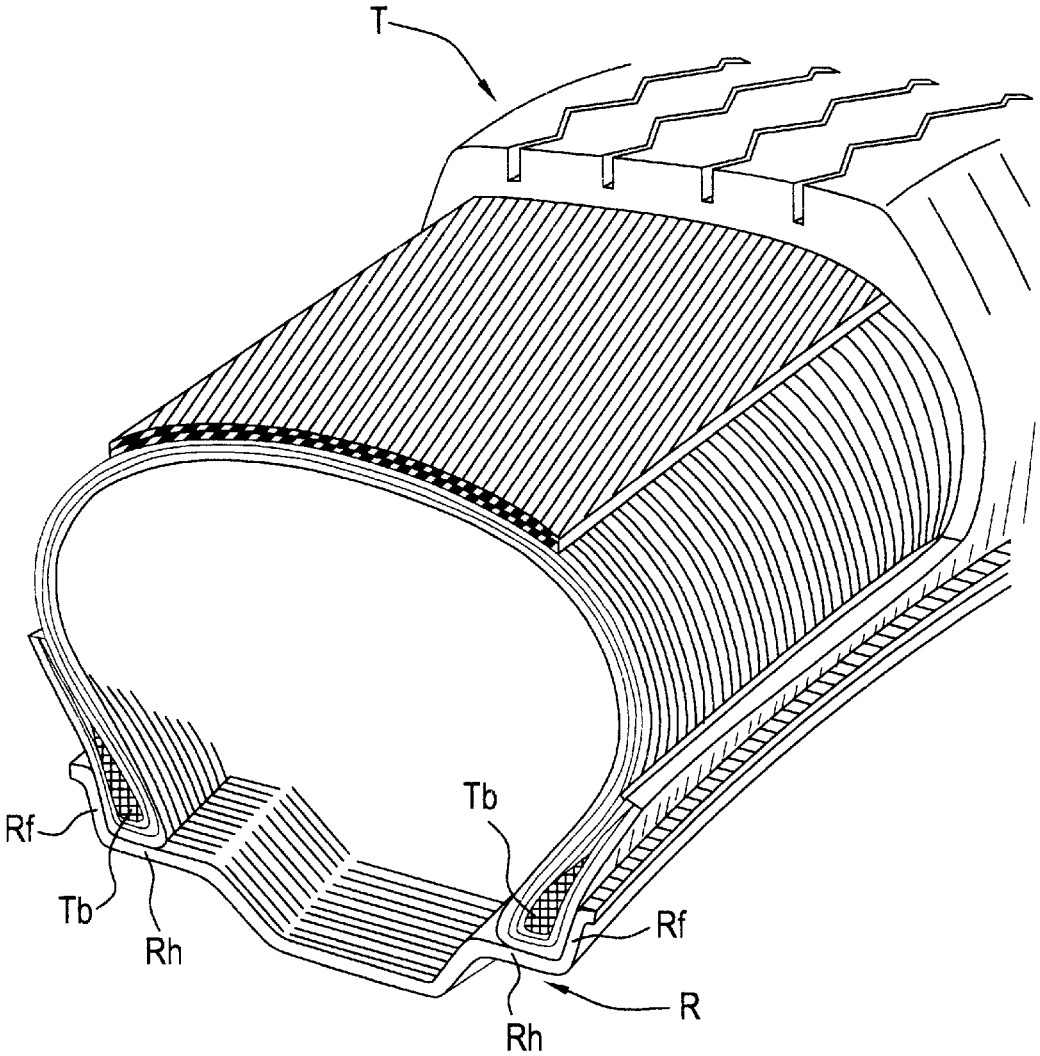
FIG. 1 is a broken perspective view of a normal vehicle wheel showing tire and rim structure.

As illustrated, the preferred embodiment of the invention includes two contact members 1*a* and 1*b* at opposite sides of an outwardly pressing presser, preferably a ram 20, which is powered by a power device, preferably a pump 30. The contact members 1*a* and 1*b* are sized to fit inside the rim R. Accordingly, the pump 30 can be operated to provide an outward pressure on the inside of the rim R via the ram 20.

The contact members 1*a* and 1*b* are preferably constructed as semi-spherical members having the same radius of curvature as the inner surface of the rim R, e.g. at the portion R*h*. In the most preferred construction, the semi-spherical members are made of solid aluminum.

Preferably, the semi-spherical members span an appreciable portion of the inner circumference of the rim R. For example, as illustrated the semi-spherical members preferably span more than 45, 60, or even 90 degrees around the circumference of the rim R. The degree of spanning should not be so great, however, that the spheres cannot be easily located within the rim when the ram 20 is in a retracted state. Accordingly, preferably the distance 11 between the outermost ends of the semi-spherical member and the distance 12 between opposite sides of the spherical members 1*a* and 1*b* are sufficiently smaller than the diameter D so as to be easily located within a bent and/or crooked rim when the ram 20 is in a retracted state—for example, 11 and 12 should preferably be at least over a few inches shorter than D.

The inventor has discovered that the width w (FIGS. 4A–4C) of the contact members 1*a* and 1*b* does not necessarily have to be altered as the radius of curvature varies. Further, in the preferred construction, the width w is approximately about 1½ inches to 2 inches across. Although the upper curved surface 3 of the spherical members 1*a* and 1*b* is preferably generally perpendicular to the center axis C (FIG. 2) of the ram, as illustrated in FIG. 4C, the surface 3 can also be formed so as to be inclined slightly; such as, for example, to conform to a shape of the rim R.

The presser can be constructed in a variety of ways. Preferably, as noted, the presser includes a ram 20, specifically a cylindrical hydraulic ram having opposing pressure members 21 and 21'. Either one or both of the pressure members 21 and 21' should be moved outwardly such that the pressure members move outwardly relative to one another. One preferred construction includes a pressure cylinder 22 having a single cylinder rod, where one of the members 21 and 21' is formed at the outer end of the single cylinder rod and the other member is formed at the rear end of the cylinder 22.

The power device can also be constructed in a variety of ways. Preferably, as noted, the power device is a pump 30—or more specifically, a manually operated hydraulic pump. As shown in FIG. 1, the pump is preferably of the type having a handle 31 which is pivotally reciprocated at the upper side 33 of the pump. Preferably, the members 21 and 21' of the ram 20 are moved further apart with each downward movement of the handle 31 about the pivot 32—which forces hydraulic fluid through the fluid conduit F into the cylinder 22 of the ram. The handle can also be, in one preferred embodiment, located and shaped so as to be operated by one's foot such that one's hands can be free to manipulate the ram and other structure of the device.

A number of known pumps and rams can be utilized in the construction of present device. Accordingly, manufacture of the present system does not require substantial further development. For example, a known 4-ton cylinder pump and a known ram manufactured by Astro, the Ram Set Kit, can be readily adapted to the present system while providing sufficient force, portability, etc., as desired.

Figure 2:
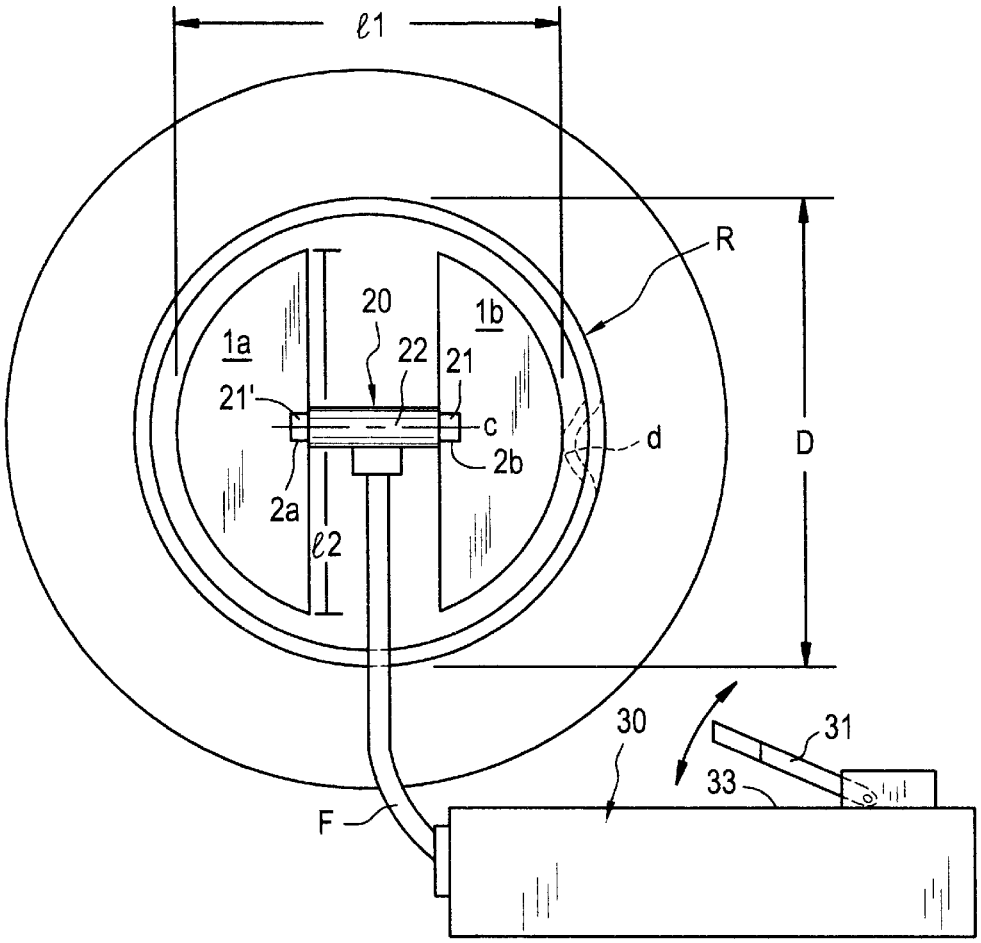
FIG. 2 is an explanatory view, according to a first embodiment, showing a top view of the wheel with the ram fitted in the rim thereof and a side view of the pump mechanism.
Figure 4A:
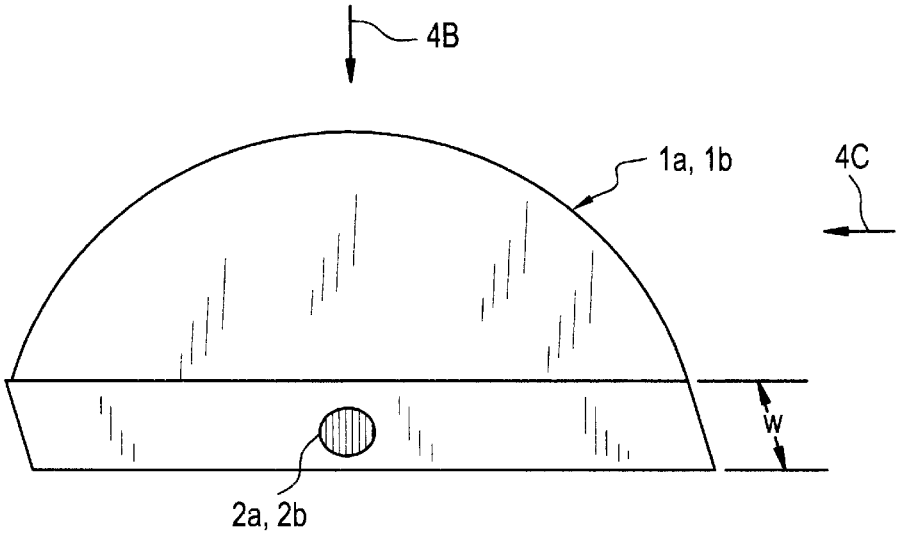
FIG. 4A is a perspective view, according to the first embodiment, of a preferred embodiment of one of the contact members.
Figure 4B:
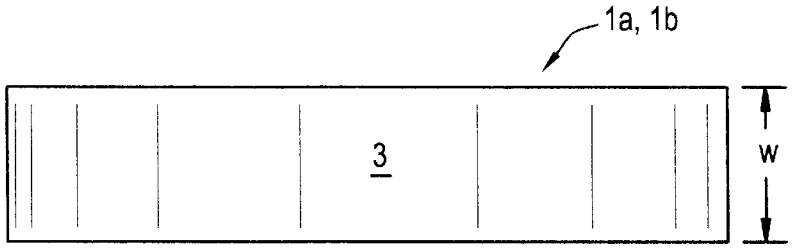
FIG. 4B is a top view (in the direction of arrow 4B shown in FIG. 4A) of the contact member shown in FIG. 4A.
Figure 4C:
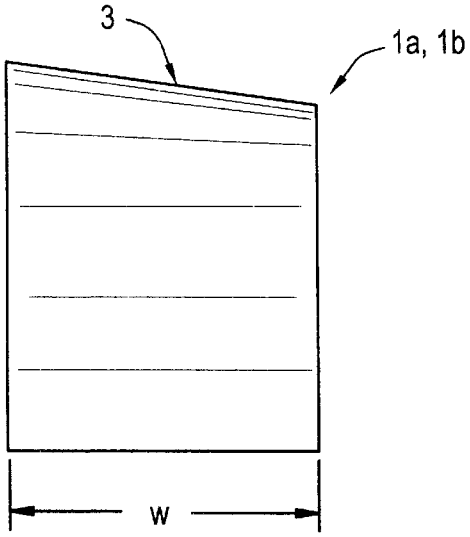
FIG. 4C is a side view (in the direction of arrow 4C shown in FIG. 4A) of the contact member shown in FIG. 4A.
Figure 5A:
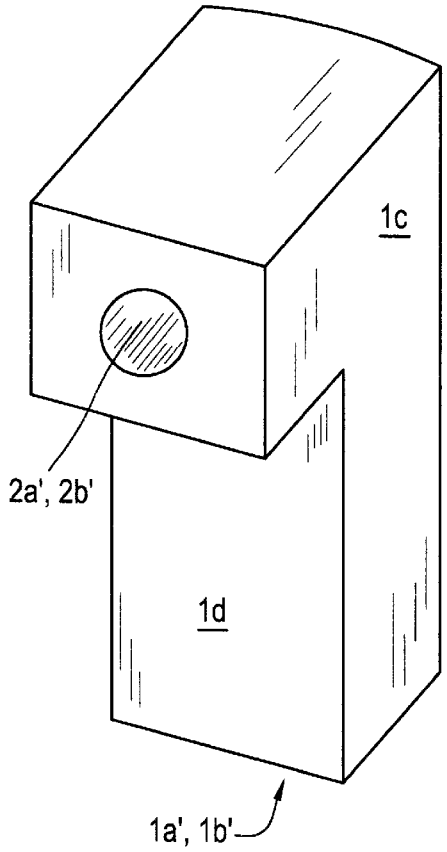
FIG. 5A is a perspective view of an alternate construction of the contact members, according to a second embodiment of the invention.
Figure 5B:
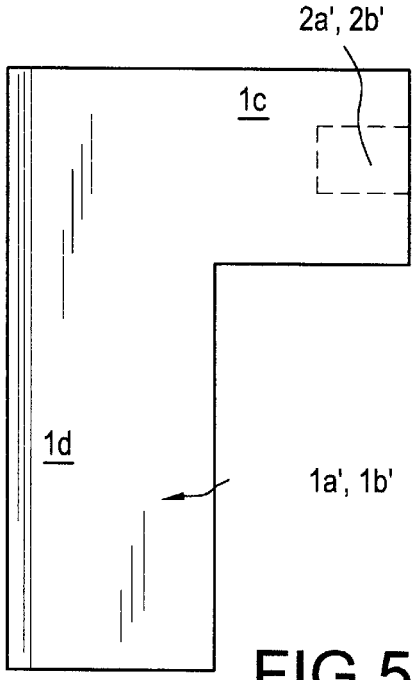
FIG. 5B is a side view of the contact member shown in FIG. 5A.
Figure 5C:
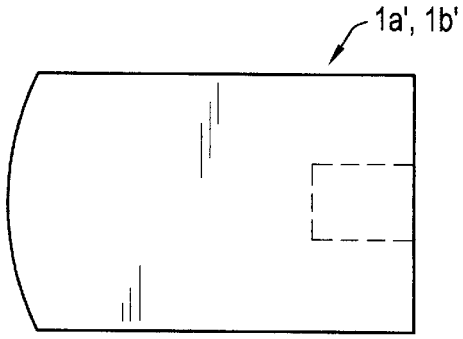
FIG. 5C is a top view of the contact member shown in FIG. 5A.
Figure 5D:
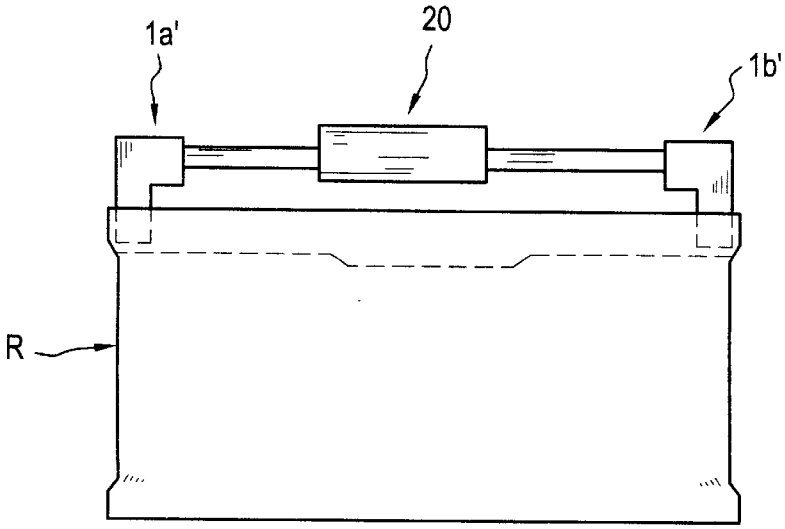
FIG. 5D is a side view of the embodiment shown in FIG. 5A in a mounted state on a vehicle rim.

As show in FIGS. 2 and 4A, the semi-spherical members 1*a* and 1*b* each preferably include a central bore 2*a* and 2*b*, respectively, which is sized so as to securely and removably slidingly receive a respective one of the members 21 and 21'. In this manner, the semi-spherical members 1*a* and 1*b* can be selected from a set of similar semi-spherical members which have different outer radii of curvature; accordingly, the spherical members can be easily chosen from the set to correspond to the inner circumference of the appropriate rim R. Preferably, the set of semi-spherical members includes pairs of semi-spherical members corresponding to 13, 14, 15, 16, and 17 inch diameter rims, whereby most common vehicle wheel rims can be repaired. Because the spherical members are pressed against the inside of the rim R, the members 21 and 21' do not require additional locking means such as screws—which facilitates replacement and use. However, although less preferred, the members 21 and 21' can also be fixedly attached to the members 1*a* and 1*b* such as by screws.

Figure 3:
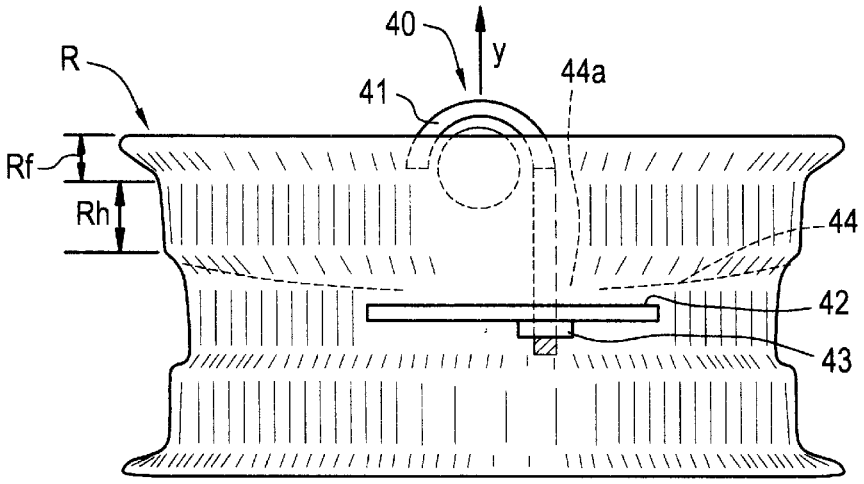
FIG. 3 is a side view, according to the first embodiment, of the wheel and the preferred ram mounting structure.

A securing device 40 is also provided in order to ensure that the contact members 1*a* and 1*b* and the ram 20 are maintained in a proper location during the operation of the device. The securing device is designed to prevent the ram 20 from moving upwardly in the direction y shown in FIG. 3. The preferred embodiment of the securing device comprises a hook 41 which extends over the cylinder of the ram 20, through the wheel rim R, and to support member 42. As shown in FIG. 3, the support member 42 is preferably a cross bar which is wider than the inner diameter of the center hole 44*a* of the center member 44. The cross bar preferably has a hole therethrough and the lower end of the hook preferably includes outer threads for threadingly attaching a nut 43.

Although the most preferred construction of the device includes the above-noted ram 20 and pump 30 structure as discussed, it is contemplated that other pressers and power devices can be used. For example, it is contemplated that the ram 20 can be replaced with a presser such as a screw shaft having a central gear and opposite threads on both ends which are threadingly engaged within the members 1*a* and 1*a*, and it is contemplated that a motor for rotating the screw shaft can replace the pump 30. In addition, other known outwardly forcing levers, linkages, gear arrangements, etc., are contemplated. However, as noted, the above-discussed structure for the presser and power device are preferred because, among other things, (a) it does not require an external power supply such as electricity, (b) it can be readily made from known devices, (c) it is easily portable, (d) it is functionally sound and reliable, etc.

FIGS. 5A to 5D show an alternative embodiment of the invention which involves contact members 1*a*' and 1*b*' which are constructed as shown. This alternative embodiment is used to straighten shallow rims, front wheel drive rims, and the like. This alternative embodiment is useful for rims such as shallow and front wheel drive rims where the depth of the rims won't allow for the device to otherwise fit therein. The contact members 1*a*' and 1*b*' are used with the ram and hydraulic pump in the same manner as the contact members 1*a* and 1*b*. Accordingly, the device is used in the same manner with either style of the contact members, and, preferably, the user can select the desired style of contact member depending on the particular wheel rim to be straightened. As shown, the contact members 1*a*' and 1*b*' have an 'L' shape, with an upper generally horizontal section 1*c* having a receiving bore 2*a*', 2*b*' therein (which recieves the ram in a like manner to the bores 2*a*, 2*b*), and with a lower generally verticle leg portion 1*d* having an outer contact surface with a radius of curvature, preferably, corresponding to the inner surface of the rim R. Once again, in the most preferred construction, the contact members are made of solid aluminum.

Operation And Method Of Use

The preferred operation and method of use of the device according to the preferred embodiments is now discussed.

First, the bent/crooked rim R is, preferably, placed generally horizontally on a support surface. Although a non-horizontal position of the rim is contemplated, a generally horizontal position facilitates handling and manipulation. The rim can also be supported above ground level to further facilitate handling. Most preferably, the bent/crooked rim R is removed from the tire T.

Second, the pressing assembly of the ram 20 and the contact members 1*a* and 1*b* are placed inside the rim as shown in FIGS. 2 and 3, and the discontinuity d is, preferably, aligned with the center axis C of the ram 20.

Third, the handle 31 is pushed to press the assembly of the ram 20 and the contact members 1*a* and 1*b* against the inner surface of the portion R*h* of the rim to hold the assembly at such a position. It is noted that during this step, one preferred embodiment contemplates holding the assembly by hand while applying the pressure via the pump—e.g. such as by pressing the handle 31 by one's foot.

Fourth, the locking means 40 is fitted in place so as to prevent the pressing assembly from coming upward out of the rim. In the preferred construction of the locking means 40, the hook 41 can be placed over the cylinder 22 and the nut 43 can be used to tighten the bar 42 against the lower side of the center member 44. Alternatively, it is also contemplated that the locking means 40 can be fitted without the above-noted third step. In addition, it is also contemplated, although also clearly less preferred, that the method can be performed without this fourth locking step.

Fifth, the ram 20 is forced outward via the pump 30 until the discontinuity is moved outward to assume the normal cylindrical shape at the portion R*h* of the rim. In the preferred operation of the device, the rim is heated in the area of the discontinuity so that the discontinuity is more easily bent back in to proper shape. In order to heat the rim, the worker can use a common hand held gas blow torch which can be manipulated by hand while the worker slowly increases the pressure of the members 1*a* and 1*b*. As noted, in a preferred arrangement, the pump can be operated by one's foot to facilitate handling of the device. Although heating is preferred, it is also contemplated that the device can be operated without the application of heat.

Sixth, if the rim is in proper form, the pressing assembly can be removed from the rim—i.e. operation is completed. However, if the portion R*f* of the rim is still bent when the rim portion R*h* has assumed the proper diameter, e.g. when the surface 3 of the contact members contacts the inner surface of the rim along the portion R*h*, the pressing assembly of the ram 20 and the contact members 1*a* and 1*b* can be left in place while additional working is done on the portion R*f*. For example, if the portion R*f* is still bent upward in the direction y of FIG. 3, the area of this bent portion can be heated and then pounded downward with a hammer or bent downward with a tool, such as a wrench or a 'crows foot'. In this manner, the assembly of the ram 20 and the contact members 1*a* and 1*b* can help to support and maintain the proper shape of the portion R*h* while the adjacent portion R*f* is manipulated. It is also contemplated, although less preferred, that the pressing assembly can be removed prior to bending the portion R*f*.

It is noted that in the method of use, the pressing assembly can be rotated, as needed, to repair discontinuities at different points around the diameter of the vehicle rim. In addition, where the portion R*h* is greater in height than the width w, the device can be secured at various elevations, as needed, such as by the third step noted above.

Advantages

As discussed, the present device and method thereof provides an efficient system specially suited and designed for use with discontinuities in vehicle wheel rims. The present invention provides a number of advantages which were not before possible with existing methods, including for example: (a) the device can be completely portable, (b) the device does not require electricity nor other power source to operate, (c) it takes little training or expertise to operate, (d) it is relatively inexpensive to manufacture, and (e) it takes much less time than the currently used methods.

Despite the longstanding problem of such discontinuities in vehicle rims, the present invention had not been contemplated, and treatment of such discontinuities has not been as simply performed—especially, by lay persons or shop mechanics. The present invention has been especially designed to correct bends, indentations and other discontinuities in vehicle rims, while still being easily handled, etc., by such lay persons and shop mechanics.

While the instant invention has been shown and described with specific reference to embodiments presently contemplated as the best mode of carrying out the invention in actual practice, it is understood that various changes may be made in adapting the invention to different embodiments without departing from the broader inventive concepts disclosed herein and comprehended by the claims which follow.

What is claimed is:

1. A device for straightening out a vehicle wheel rim, comprising:

a presser;

opposing pressure members on opposite ends of said presser;

a power device for powering said presser to move said opposing pressure members outwardly away from each other;

a first semi-spherical contact member on a first of said pressure members;

a second semi-spherical contact member on a second of said pressure members;

said first and second semi-spherical contact members having outwardly facing spherical surfaces;

wherein said first and second semi-spherical contact members are fittable within a vehicle wheel rim for straightening a bent portion of the rim;

a securing device for securing said presser to a wheel rim, said securing device including a member that extends over said presser and a member that engages an opposite side of said wheel rim through a center hole in said wheel rim; and wherein the presser is a ram and the power device is a hydraulic pump.

2. The device of claim 1, wherein the hydraulic pump is manually operated via a pump handle.

3. The device of claim 1, wherein said contact members are semi-spherical solid aluminum members.

4. The device of claim 1, wherein said first and second contact members each have an L-shape with an upper generally horizontal section which engages said pressure members and with a lower generally vertical leg portion having an outer semi-spherical contact surface.

5. A system for straightening out vehicle wheel rims, comprising:

a presser;

opposing pressure members on opposite ends of said presser;

a power device for powering said presser to move said opposing pressure members outwardly away from each other;

a plurality of pairs of first and second contact members which are removably replaceable on a first of said pressure members and a second of said pressure members, respectively;

each said pair of first and second contact members having outwardly facing spherical surfaces differing in radius of curvature;

whereby one of said pairs of first and second contact members can be fit within an appropriately sized diameter wheel rim for straightening a bent portion of the rime;

a securing device for securing said presser to a wheel rim, said securing device including a member that extends over said presser and a member that engages an opposite side of said wheel rim through a center hole in said wheel rim; and wherein the presser is a ram and the power device is a hydraulic pump.

6. The device of claim 5, wherein the hydraulic pump is manually operated via a pump handle.

7. The device of claim 5, wherein the contact members are semi-spherical solid aluminum members.

8. A method for straightening out a vehicle wheel rim, comprising the steps of:

a) providing a device comprising: a presser having opposing pressure members; a power device for moving said opposing pressure members of said presser outwardly away from each other; a pair of first and second contact members which are removably replaceable on a first of said pressure members and a second of said pressure members, respectively; said first and second contact members having outwardly facing contact surfaces; wherein said step of providing further comprises the step of providing the presser as a ram and the power device as a hydraulic pump;

b) placing the pressure members inside a vehicle wheel rim such that said pressure members face a discontinuity in the rim;

c) securing said presser to the wheel rim with a securing device including a member that extends over said presser and a member that engages an opposite side of said wheel rim through a center hole in said vehicle wheel rim;

d) operating said device to press against the discontinuity to reshape the rim.

9. The method of claim 8, wherein said step of operating includes operating the hydraulic pump manually via a pump handle.

10. The method of claim 8, wherein said step of providing further comprises the step of providing the contact members as semi-spherical solid aluminum members.

11. The method of claim 8, wherein said step of operating further comprises the step of simultaneously heated the rim.

* * * * *